US006413231B1

(12) United States Patent
Berman et al.

(10) Patent No.: US 6,413,231 B1
(45) Date of Patent: Jul. 2, 2002

(54) DEVICE TO ASSIST IN THERAPY OF PATIENT WHO HAS LIMITED JAW OPENING

(75) Inventors: Barry R. Berman, Owings Mills; David H. Shulman, Hunt Valley; George R. Hepburn, Severna Park; Russell L. Vedeloff, Greensboro, all of MD (US)

(73) Assignee: Dynasplint Systems, Inc., Severna Park, MD (US)

( * ) Notice: Subject to any disclaimer, the term of this patent is extended or adjusted under 35 U.S.C. 154(b) by 0 days.

(21) Appl. No.: 09/413,365

(22) Filed: Oct. 6, 1999

(51) Int. Cl.[7] ..... A61H 1/00; A61H 1/02; A63B 23/03

(52) U.S. Cl. ..... 601/38; 482/11

(58) Field of Search ..... 601/38, 5; 482/11; 433/140, 136, 138, 1; 602/17

(56) References Cited

U.S. PATENT DOCUMENTS

| | | | | | |
|---|---|---|---|---|---|
| 742,698 | A | | 10/1903 | Mason | |
| 972,983 | A | | 10/1910 | Arthur | |
| 976,812 | A | | 11/1910 | Koehler | |
| 1,025,265 | A | | 5/1912 | Grindle | |
| 1,229,595 | A | | 6/1917 | Du Brul | |
| 1,311,313 | A | | 7/1919 | Brix | |
| 1,851,865 | A | * | 3/1932 | Ptacek | 482/11 |
| 2,061,936 | A | | 11/1936 | Engelfried | 128/12 |
| 2,182,390 | A | | 12/1939 | Reardon | 128/6 |
| 3,721,439 | A | * | 3/1973 | Rudolph | 482/11 |
| 3,938,508 | A | * | 2/1976 | Buckner | 482/11 |
| 4,700,695 | A | * | 10/1987 | Davis et al. | 601/38 |
| 4,991,566 | A | | 2/1991 | Shulman et al. | 128/17 |
| 5,035,420 | A | | 7/1991 | Beeuwkes, III et al. | 272/95 |
| 5,097,820 | A | | 3/1992 | Shulman et al. | 128/17 |
| 5,176,594 | A | * | 1/1993 | Lee | 482/11 |
| 5,462,435 | A | * | 10/1995 | Young | 433/140 |
| 5,558,624 | A | | 9/1996 | Hepburn et al. | 601/33 |
| 5,645,521 | A | | 7/1997 | Hepburn et al. | 601/33 |
| 5,718,665 | A | | 2/1998 | Stubbs | 600/243 |
| 5,846,212 | A | | 12/1998 | Beeuwkes, III et al. | 601/38 |
| 5,897,491 | A | | 4/1999 | Kastenbauer et al. | 600/239 |
| 5,919,116 | A | * | 7/1999 | Edell | 482/11 |

FOREIGN PATENT DOCUMENTS

| | | |
|---|---|---|
| GB | 17220 | of 1900 |
| GB | 674272 | 6/1952 |

* cited by examiner

*Primary Examiner*—Denise M. Pothier
(74) *Attorney, Agent, or Firm*—Robert M. Gamson; Leonard Bloom

(57) ABSTRACT

A device to be held in the mouth of a patient who has limited jaw opening and to assist in the therapy. The device has a frame with opposite side members having adjustable lengths. A rotatable knob drives a threaded screw to change the tension applied to a pair of springs. The springs activate a cam to raise or lower an upper mouthpiece with respect to a lower mouthpiece and to thereby adjust the jaw opening of the patient.

18 Claims, 14 Drawing Sheets

DEVICE TO ASSIST IN THERAPY OF PATIENT WHO HAS LIMITED JAW OPENING

FIELD OF THE INVENTION

The present invention relates to a device to assist in the therapy of a patient and, in particular, to a patient who has limited jaw opening due to any number of causes such as muscle injury, surgical procedures, radiation therapy, temporomandibular joint dysfunction, osteoarthritis, post infection, or trauma.

BACKGROUND OF THE INVENTION

There are many persons who are limited in the extent to which they are able to open their mouths. Some of the causes of this problem are listed above. This problem is frequently referred to as trismus. A person afflicted with trismus is not able to fully open their lower jaw. This is problematic in that, often, access to the interior of the afflicted person's mouth and throat is necessary to effectively treat the cause of the affliction. Approximately 75,000 to 100,000 persons in the United States require treatment for this ailment annually.

Additionally, there are other occasions, such as during an examination or any procedure performed with or without general or local anesthesia, when the patient's mouth must be propped open.

The applicants are aware of devices for dilating and/or propping open a human mouth. The Dingman Mouth Gag is a frame with coiled springs, tongue depressors, cheek retractors and movable tooth hooks which is positioned in front of the mouth. In U.S. Pat. No. 742,698 to Mason, a dental prop is disclosed which has pivoted jaws and tooth pads on the inner ends of the jaws. Arthur, in U.S. Pat. No. 972,983 discloses a dilator having a handle with four sockets in which are received four blades. The handle may be turned to move the blades. Koehler, in U.S. Pat. No. 976,812 discloses a mouth speculum having a pair of pivotally connected jaw bars which have ends to engage teeth within a mouth. Rotation of a bolt provides a means to open and close the jaws. In U.S. Pat. No. 1,025,265, Grindle discloses a cheek distender having two pivotally connected handles with bow-shaped arms and cheek plates on the ends of the arms. In U.S. Pat. No. 1,229,595, Du Brul discloses a dental appliance having a prop to hold the mouth open. The appliance has two sections connected by a spring hinge. A plate is attached to one section to engage the teeth. The other section has means to hold a clam roll in place. In U.S. Pat. No. 1,311,313 Brix discloses a retractor having two parallel bars spaced apart by an arm at one end and a plate at the other. A movable arm is carried by one of the parallel bars. Hooks are formed on the ends of the arms. A slidable bar is connected to the other parallel bar. On the end of the slidable bar is a hook which can be moved with respect to the parallel bars. In U.S. Pat. No. 2,061,936 issued to Engelfried, a mouth prop is disclosed that is inserted between a patient's teeth. This device includes a threaded bolt that carries a pair of bars thereon that, carrying tooth engagement means thereon, are linearly movable to prop a mouth open. In U.S. Pat. No. 2,182,390 issued to Reardon, a surgical device is disclosed for propping open the mouth of a patient, so as to permit access to and illumination of the area in back of the nose and above the palate. In U.S. Pat. No. 5,718,665, Stubbs discloses an animal speculum wherein first and second arms connected by a threaded rod are provided. By rotating the rod, the distance between the first and second arms may be selectively adjusted. In U.S. Pat. No. 5,846, 212, Beeuwkes, III et al disclose a device for omnidirectional translation of the mandible of a human patient. The device provides for translation and lateral movement. Kastenbauer et al, in U.S. Pat. No. 5,897,491 disclose a device for endoscopic examination which includes a vertical frame with locking and vertical frame with locking and spreading instruments attached to the frame and extending horizontally from the frame. Esselbach, in UK Patent 17.220 discloses a mouth opening instrument having angularly bent levers hinged together. The ends of the arms of the levers carry mouthpieces which are spring actuated into an open position. Schranz, in UK Patent 674.272 discloses a retractor which has two curved arms which are pivotally connected to a bridge member. Each curved arm has a shortened arm which is received in a central traveling block. A gear box is mounted in the center of the bridge member. The curved arms open and close.

While being useful for their purpose, most of these patented devices have particular drawbacks, especially where the patient is afflicted with trismus. In particular, the jaw supporting portions move away from and towards one another in a straight linear fashion. Unfortunately, the mandible does not move in such a linear fashion. The jaw joint is a ginglimoarthroidial joint and, as such, moves in a sliding pivotal articulation (where the lower jaw joins the skull), such that the lower jaw pivotally moves away from and towards the skull in a substantially arcuate path. Thus, if the devices such as disclosed in Engelfried and Reardon would be utilized to open a jaw afflicted with trismus, the tooth engaging portions thereof, while moving linearly, would slip or ride over the teeth of the jaw, which moves arcuately. Such an arrangement can result in breaking and/or other damage occurring to the teeth and/or jaw of the patient.

U.S. Pat. No. 5,035,420 to Beeuwkes, III et al, disclose a jaw exerciser which has curvilinear guide tracks to guide movement of a carriage which provides corresponding movement of a mandibular jaw member. The mandibular jaw member is supported by the carriage.

U.S. Pat. Nos. 4,991,566 and 5,097,820 to Shulman et al address the arcuate movement of the jaw and disclose devices which move similarly to the natural movement of the jaw. However, the devices can be substantially improved and the present application discloses improvements to these devices.

BRIEF SUMMARY OF THE INVENTION

It is a primary object of the present invention to provide a device for opening the jaw of a patient in therapy of the patient.

It is a further object to provide a jaw opening device in which the tension applied to the jaw can be varied quantitatively and in small, controllable increments.

In accordance with the teachings of the present invention, there is disclosed a device to assist in the therapy of a patient who has limited jaw opening. The device has a rectangular frame having two opposite side members. The side members have adjustable lengths. Means are provided to adjust the lengths of the side members concurrently. Each side member has a first end and an opposite second end. An upper mouthpiece and a lower mouthpiece are connected between the respective first end of the side members of the frame. The upper mouthpiece and the lower mouthpiece have a distance therebetween wherein adjusting the lengths of the side members of the frame changes the distance between the upper mouthpiece and the lower mouthpiece. When the mouthpieces are received in the mouth of the patient, the jaw opening of the patient is adjustable.

In further accordance with the teachings of the present application, there is disclosed a device to assist in the therapy of a patient who has limited jaw opening. The device has a frame having two side members, the side members having adjustable lengths. Each side member has a first end and an opposite second end. Means are provided to adjust the lengths of the side members concurrently. An upper mouthpiece and a lower mouthpiece are connected between the respective first ends of the side members of the frame, the upper mouthpiece and the lower mouthpiece having a distance therebetween. Each side member has a center bore formed longitudinally therethrough. A spring is disposed in each bore, the spring having a first end and a second end. An adjusting means is connected to the first end of each spring. A chuck tip is connected to the second end of each spring. Two heads are provided, the first end of each side member being connected to a respective one of the heads. Each head has an opening therein. A respective joint is received in each opening in the respective heads. A cam surface is formed on each joint, the respective chuck tip bearing on the cam surface. Two spaced-apart sleeves are provided, the respective second ends of each side member being telescopically received in the respective sleeve. Changing the adjusting means on the first end of each spring changes the tension of the respective springs with respect to the cam surface and telescopically moves the respective side members with respect to the sleeves. In this manner, the distance between the upper mouthpiece and the lower mouthpiece is changed, such that the jaw opening of the patient is adjustable in controllable increments.

These and other objects of the present invention will become apparent from a reading of the following specification taken in conjunction with the enclosed drawings.

DESCRIPTION

Figure 7:
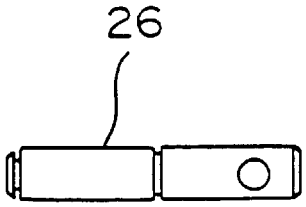
FIG. 7 is a side elevational view of the control shaft.

Referring now to FIGS. 1–6, the device 10 has a frame which has a pair of opposite side members 12 which are adjustable in their effective length with respect to the size of the frame. Each side member 12 has a respective first end 14 and second end 16. The second ends 16 are each received in a respective sleeve 18 wherein the second ends 16 may telescope within the sleeve 18 as the side member 12 moved to lengthen or shorten the frame. Each sleeve 18 is connected to a housing 20, the sleeves 18 being spaced apart. Within the housing 20, there are two drive means 22, and two sets of sprockets 24, 24'. One pair of sprockets 24 are keyed to, and rotated by, a control shaft 26. These sprockets 24 drive both drive means 22 which, in turn, drive the other pair of sprockets 24'. The sprockets 24' are driven by the drive means 22 in a first direction and an opposite second direction as selected. The driven sprockets 24' are connected to means to move the side members 18 as will be described. The control shaft 26 (FIG. 7) extends out of the housing 20 away from the side members 12. A knob 28 or control means is mounted on the control shaft 26 externally of the housing 20 and distally of the side members 12. Rotation of the knob 28 in a first direction produces concomitant rotation of drive means 22 and rotation of the knob 28 in an opposite second direction reverses the direction of rotation of the drive means 22. Thus, rotation of the knob 28 produces lengthening or shortening of the side members 12 by telescoping the side members into the respective sleeves 18 as will be described. As the knob 28 is rotated, the side members 12 both move concurrently and equidistantly.

The preferred embodiment is a plurality of sprockets 24, 24' and two pitch chain drive means 22. However, other means known to persons skilled in the art may be disposed in the housing 20 to lengthen and shorten the side members 12.

Figure 8:
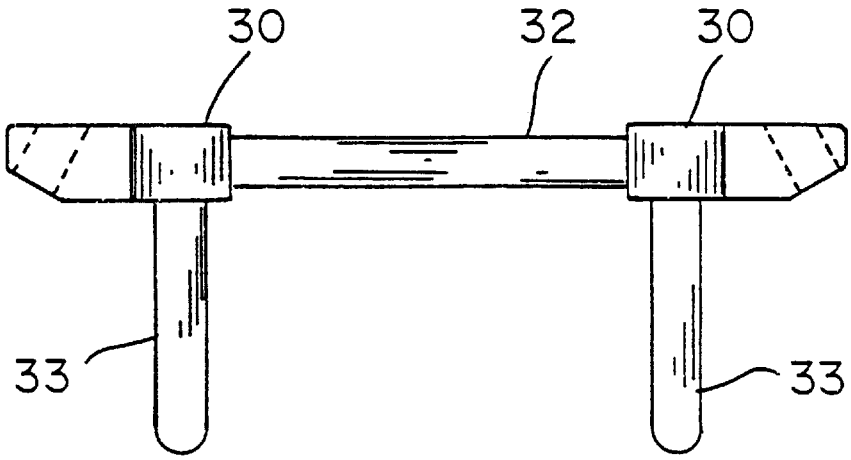
FIG. 8 is a top plan view of the cross brace knuckles and cross brace rod.
Figure 9:
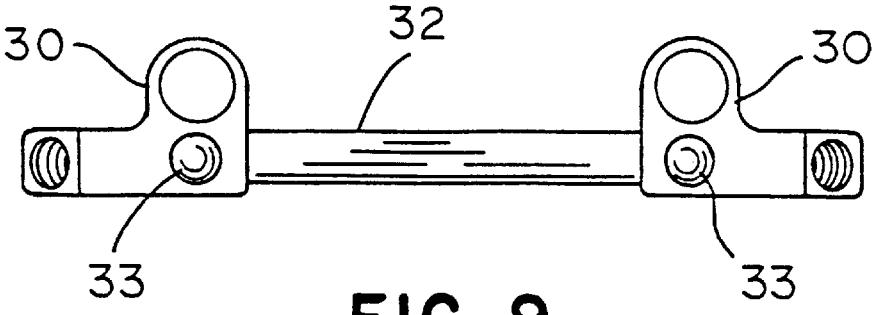
FIG. 9 is a side elevational view of the cross brace knuckles and the cross brace rod.

The first end 14 of each side member 12 is connected to a respective cross brace knuckle 30 (FIGS. 8 and 9). Preferably, the side member 12 is received in an opening in the respective cross brace knuckle 30 and extends outwardly on both sides of the opening. A lower stem rod 33 is connected to the cross brace knuckle 30 and extends oppositely from the housing 20 and is disposed under the head 34. A cross brace rod 32 connects the cross brace knuckles 30 and is opposite from the housing 20. Thus, the device 10 has a frame formed by the two side members 12, the housing 20 and the cross brace rod 32. Preferably, the frame is square or rectangular with the side members 12 being parallel to one another and the housing 20 and cross brace rod 32 being approximately perpendicular to the side members 12. However, the device 10 is not limited to a rectangle or square and may be other configurations including triangular and trapezoidal.

Figure 11:
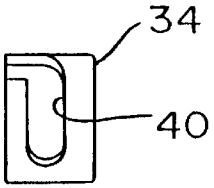
FIG. 11 is a front elevational view of the head.
Figure 13:
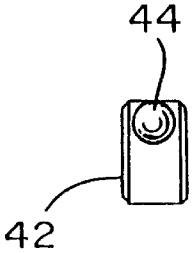
FIG. 13 is a front view of the joint with the stem rod.
Figure 10:
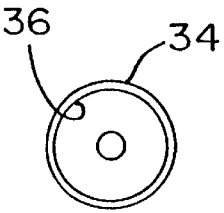
FIG. 10 is a side elevational view of the head.
Figure 12:
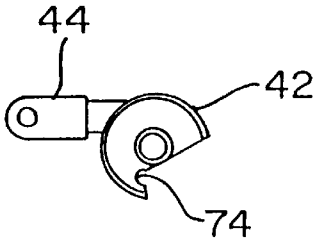
FIG. 12 is a side elevational view of the joint with the stem rod.

A respective head 34 (FIGS. 10 and 11) is connected to the first end 14 of each side member 12. Each head 34 has an opening 36 formed in one side thereof, the side being oriented outwardly from the device 10. A plate cap 38 is attached to each head 34 to enclose the opening 36. Preferably, a threaded screw is received in a hole in the plate cap to attach the plate cap 38. An inverted L-shaped slot 40 is formed in the front surface of the head 34, the slot communicating with the opening 36 in the head 34. A joint 42 with a stem rod 44 extending outwardly therefrom is received in the opening 36 in the head 34. The stem rod 44 is received in the slot 40 and is directed angularly upwardly away from the housing. The joint 42 has a cam surface 74 formed opposite from the stem rod 44.

Figure 14:
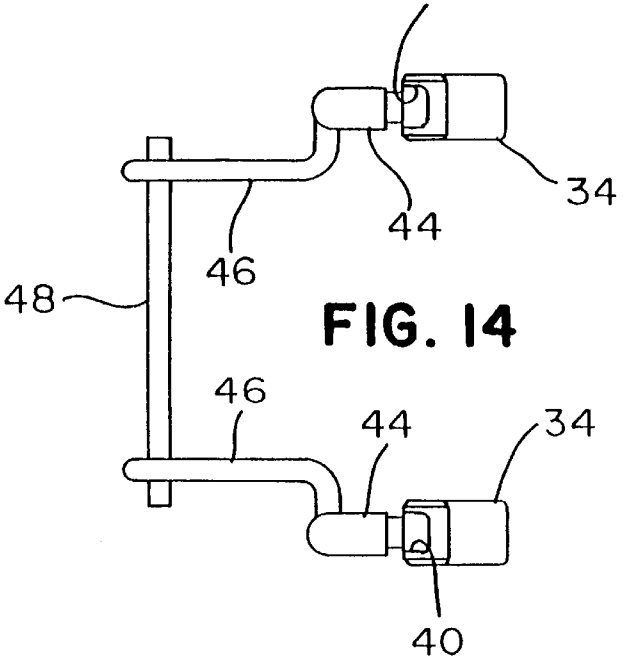
FIG. 14 is a bottom plan view of the subassembly for the upper mouthpiece.
Figure 15:
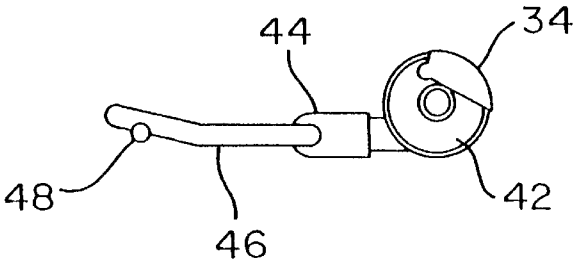
FIG. 15 is a side elevational view of FIG. 14.

As shown in FIGS. 14 and 15, L rods 46 are connected to each of the stem rods 44, the L rods 46 being directed toward each other. An upper pivot rod 48 extends between and beyond the L rods 46 and is connected to the L rods 46. The upper mouthpiece 50, preferably formed from plastic, has a notch formed in each sidewall of the upper mouthpiece 50 wherein the upper pivot rod 48 is frictionally received and retained in the respective notches.

Figure 16:
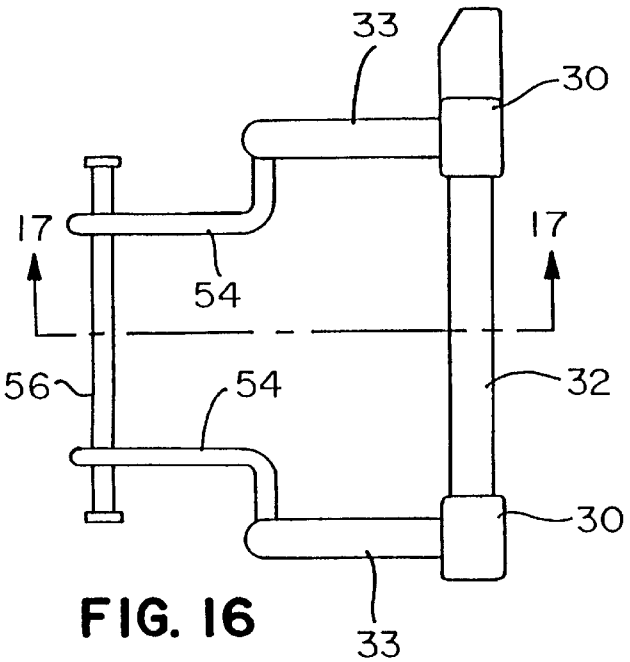
FIG. 16 is a top plan view of the subassembly for the lower mouthpiece.
Figure 17:
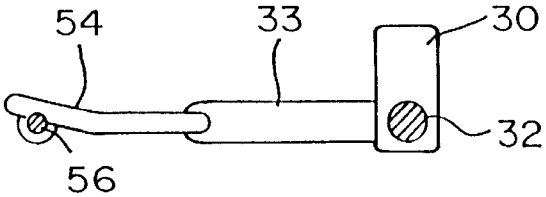
FIG. 17 is a cross-sectional view taken across the lines 17—17 of FIG. 16.

The subassembly for the lower mouthpiece 52 is shown in FIGS. 16 and 17. Lower L rods 54 are connected to each of the lower stem rods 33. A lower pivot rod 56 is connected to each of the lower L rods 54 and extends outwardly from each lower L rod 54. The lower mouthpiece 52, preferably formed of plastic has a notch formed in each sidewall of the lower mouthpiece 52 wherein the lower pivot rod 56 is frictionally received and retained in the respective notches.

Although the above retention means for the upper mouthpiece 50 and the lower mouthpiece 52 is preferred, other retention means known to persons skilled in the art may be used. It is understood that the upper mouthpiece 50 and the lower mouthpiece 52 are both pivotally attached to the respective upper pivot rod 48 and lower pivot rod 56 such that the mouthpieces may move about the respective pivot rods when held between the teeth or the jaws of the patient. This pivoting mounting provides a more comfortable and natural interface between the device 10 and the patient.

Figure 25:
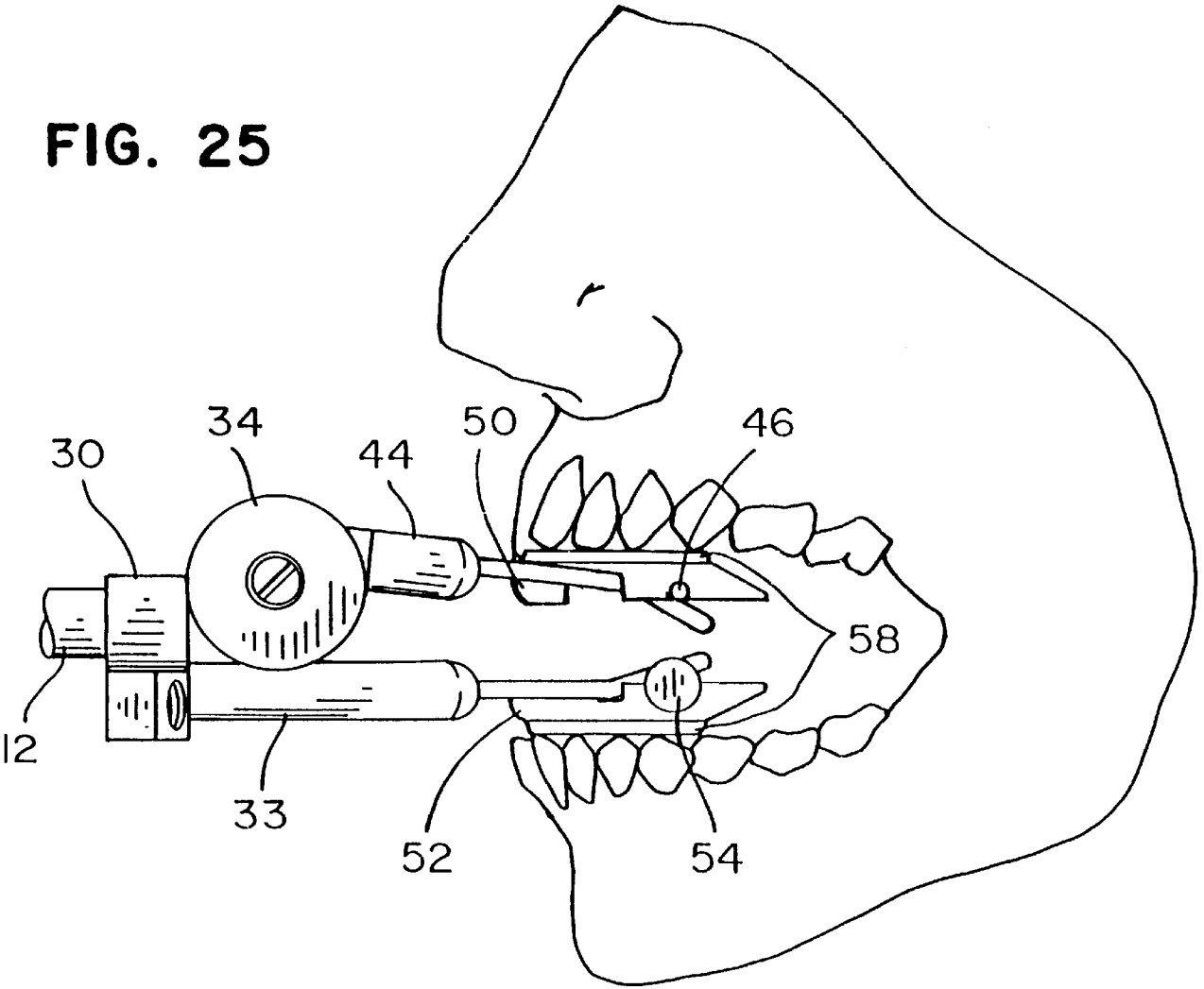
FIG. 25 is a partial cut-away side view showing the present invention engaging the teeth in the patient's mouth.

It is also preferred that a replaceable mouthpiece pad 58 be used with each mouthpiece 50, 52 to cushion the teeth and jaws of the patient as well as for hygienic reasons (FIG. 25). The mouthpiece pad 58, preferably, is adhesively attached to the respective mouthpieces 50, 52 and is made of a resilient foam material.

Figure 18:
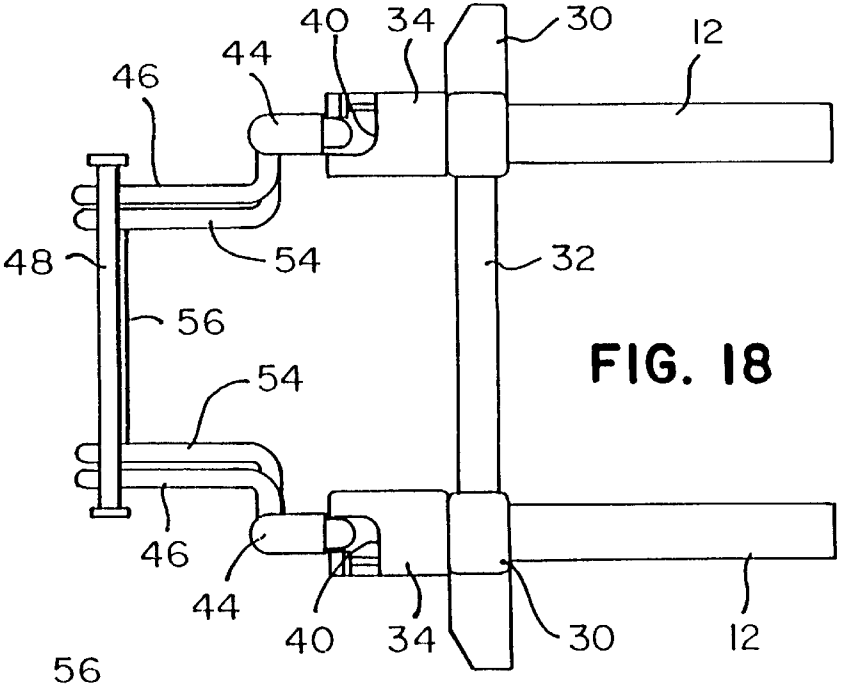
FIG. 18 is a top plan view of the subassemblies for holding the mouthpieces with the mouthpieces not shown.
Figure 19:
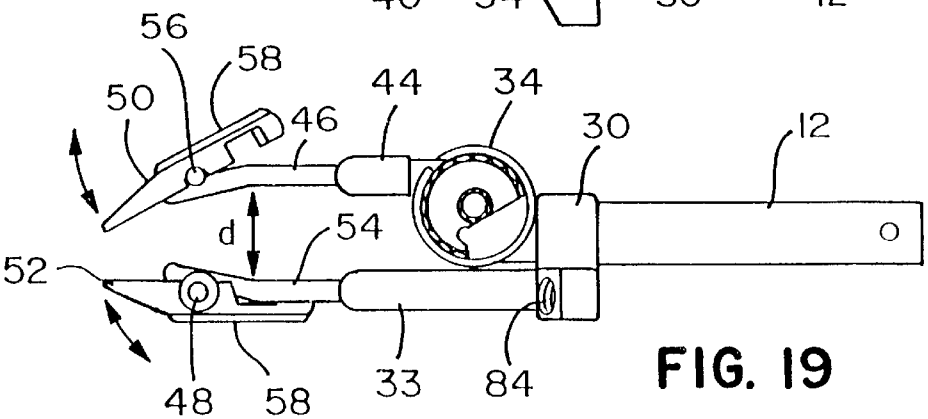
FIG. 19 is a side elevation view of the subassemblies of FIG. 18 with the mouthpieces attached and showing pivotal movement of the mouthpieces. The plate cap of the head is not shown.

As shown in FIGS. 18 and 19, the subassembly for the upper mouthpiece 50 is disposed above the subassembly for the lower mouthpiece. The lower subassembly is stationary and the upper subassembly may be elevated and lowered to change the distance d between the upper mouthpiece 50 and the lower mouthpiece 52.

Figure 20:
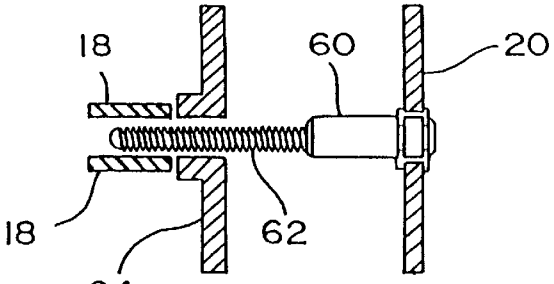
FIG. 20 is a cross-sectional view of the loading screw connected to the loading shaft and mounted in the housing.
Figure 21:
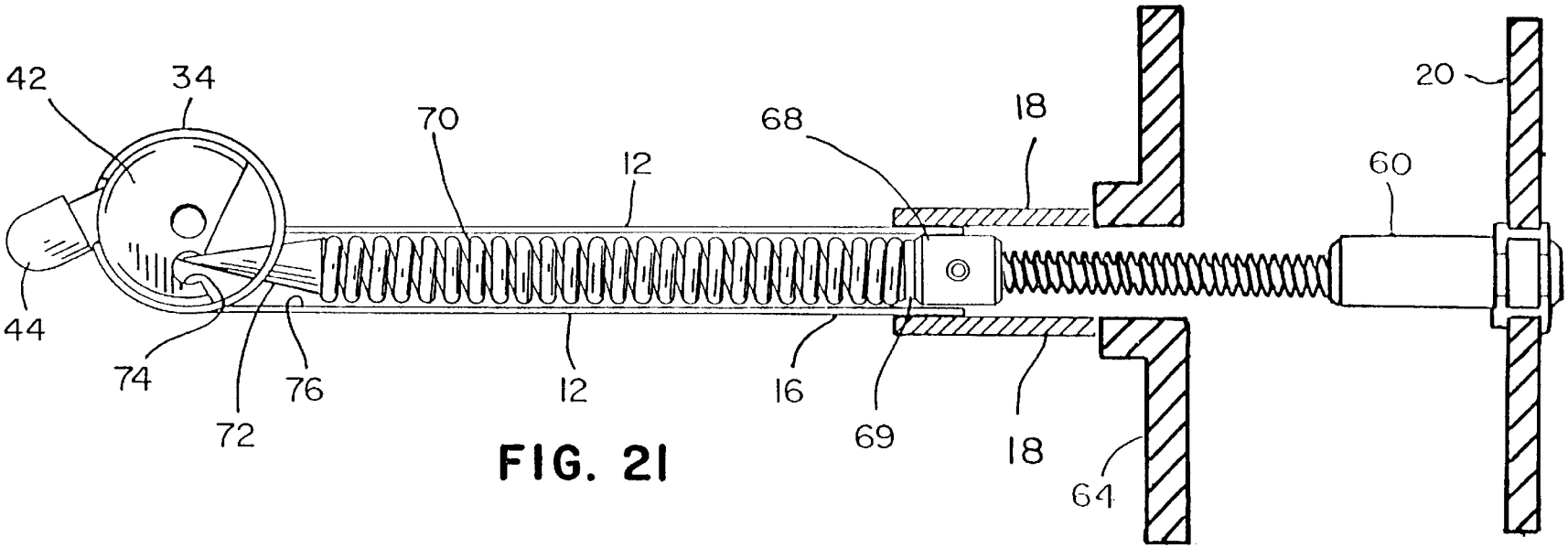
FIG. 21 is a partial cross-sectional view showing the spring extended and chisel tip disposed in the bore in the side members and contacting the cam surface in the joint.
Figure 22:
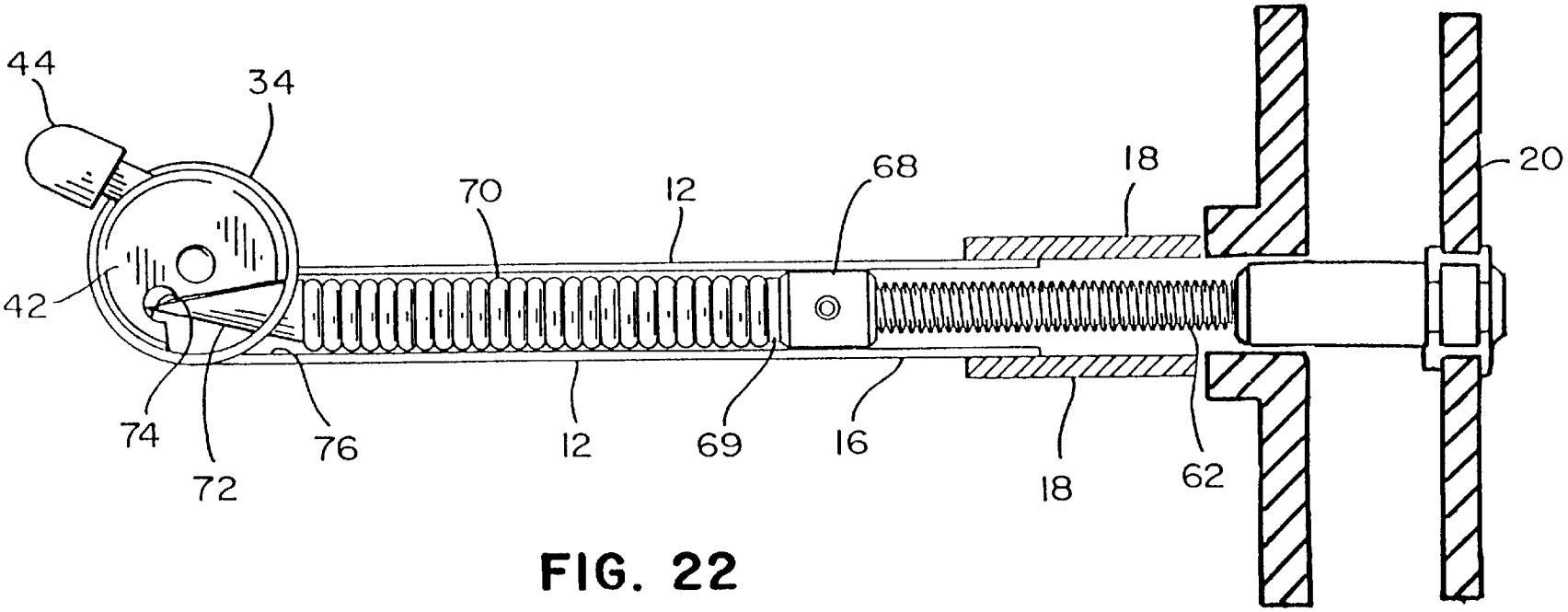
FIG. 22 is the same as FIG. 21 with the spring compressed.

Two loading shafts 60 are connected to the rear surface of the housing 20 in a spaced-apart manner. The method of connection is not critical. In a preferred embodiment, each loading shaft 60 has circumferential channel formed near the end of the shaft. As shown in FIG. 20, each shaft 60 is mounted in an opening in the housing so that the end with the channel extends exteriorly of the housing 20 and a retainer such as an E ring is received in the channel. The major portion of the loading shaft extends interiorly into the housing 20. Each loading shaft 60 is connected to a loading screw 62. Each loading screw 62 extends through the housing 20 and passes through a respective opening in the front surface 64 of the housing. Each loading screw extends into a respective sleeve 18 without contacting the sleeve 18. A loading nut 68 is threadingly engaged on the loading screw 62 as shown in FIGS. 21 and 22. The first end of a resilient means such as a coil spring 70 is connected to the loading nut 68 through a spring spacer 64. The second, opposite, end of the spring 70 is connected to a chisel tip 72 or nose. The chisel tip 72 bears on a cam surface 74 which is formed on the joint 42. The cam surface is an arcuate cavity formed between two flat surfaces. The tip of the chisel 72 engages the cavity and the flat surfaces act as a stop when the joint 42 has moved to a position wherein the respective flat surface contacts the respective side of the chisel 72. As the chisel tip 72 is urged forwardly or backwardly by the resilient spring 70, the cam surface 74 is urged clockwise or counterclockwise. The action is referred to herein as cam action for ease of expression although it is concentric planetary rotation. Each spring 70 is disposed in a longitudinal bore 76 in the respective side members 12. Preferably, the entire spring 70 and loading nut 68 are received within the bore 76 in the side member 12. The second end 16 of the side member 12 is telescopically received within the sleeve 18 and remains within the sleeve through the movement of the side member 12. The spring, chisel tip and cam action have been disclosed in U.S. Pat. Nos. 5,558,624 and 5,645,521 issued to Hepburn et al.

In operation of the device 10, when the knob 28 is rotated in a clockwise direction, the control shaft 26 is rotated clockwise. The sprockets 24 which are keyed to the control shaft 26 are rotated clockwise and move the drive means 22. The drive means 22 drive the sprockets 24' in a clockwise direction. The sprockets 24' which are keyed to the loading shafts 60, advance the screws 62 against the loading nuts 68, spring spacers 69 and springs 70. The chisel tips 72 are moved forwardly against the cam surface 74 and the joints 42 are moved clockwise to elevate the stem rods 44 and the upper mouthpiece 50.

As the knob 28 is rotated, a quantifiable force is applied which extends the spring 70. In turning the knob 28 and, ultimately, the screw 62, greater compression is applied to the spring 70 which, in turn, exerts greater force on the chisel tip 72 and the cam surface 74 to exert a one way tension. The tension capability can range from 0, when the spring 70 is not compressed, up to the maximum tension capability of the spring.

When the knob 28 is rotated in a counterclockwise direction, the above movement is reversed and the upper mouthpiece 50 is depressed with respect to the lower mouthpiece 52.

Figure 1:
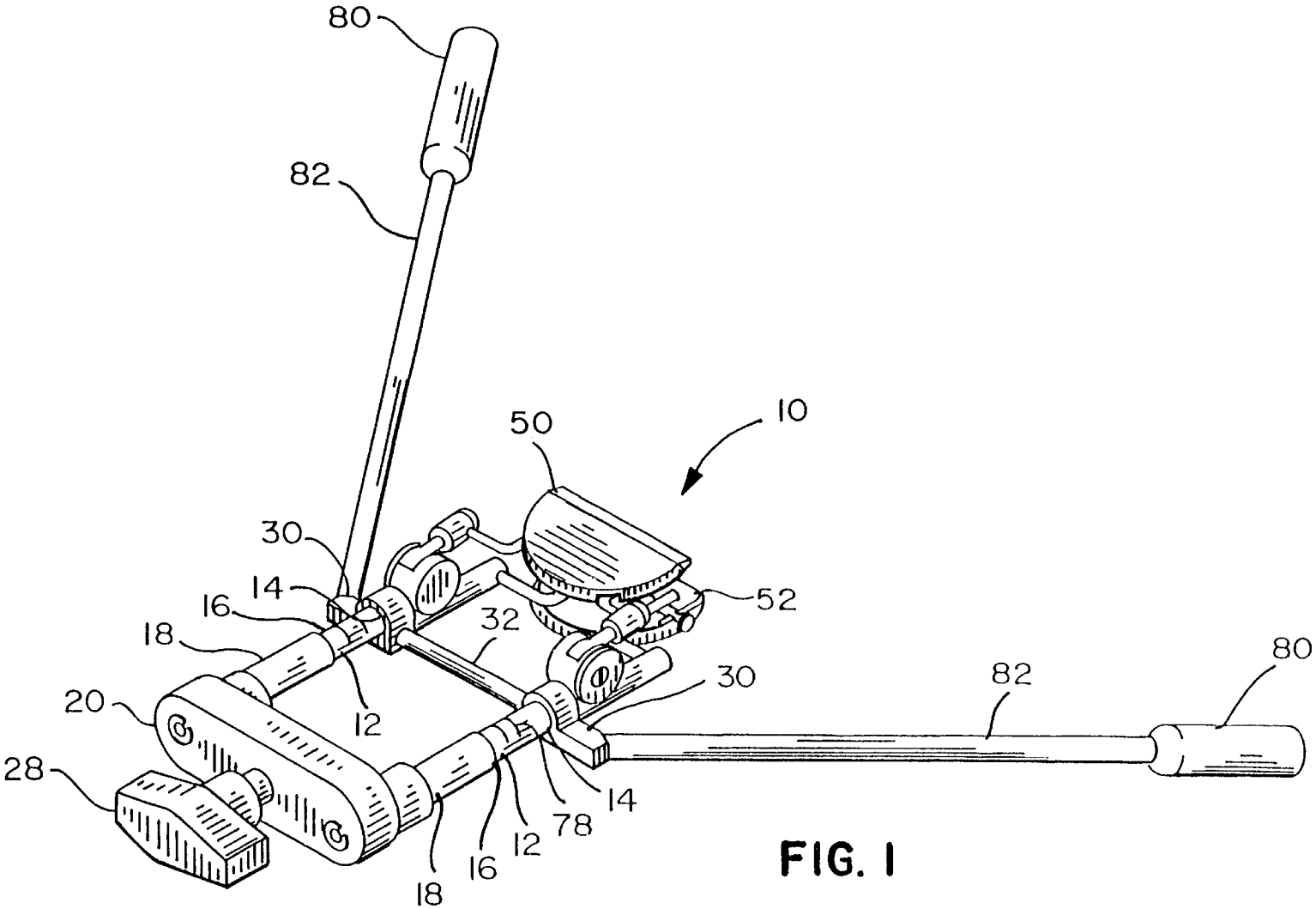
FIG. 1 is a perspective view of the device of the present invention.
Figure 2:
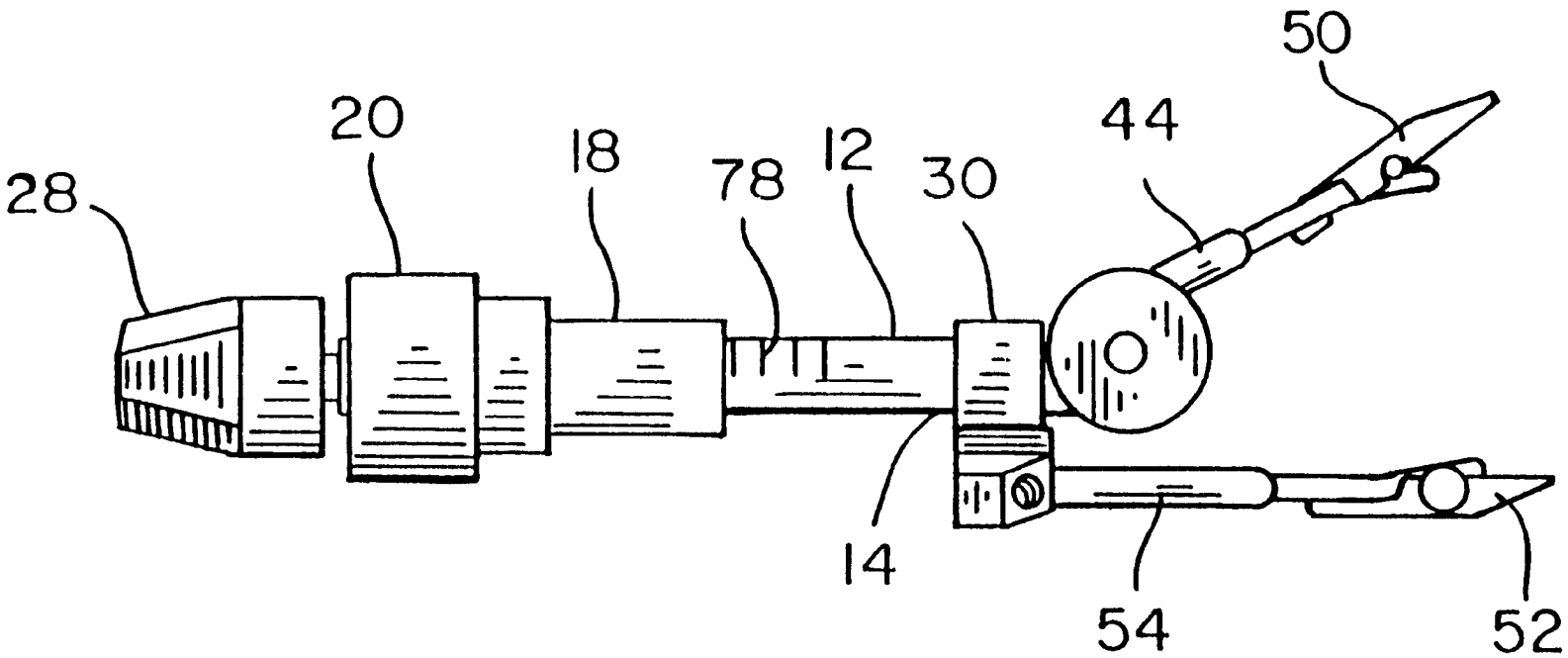
FIG. 2 is a side elevation view with the counterbalance rod not shown.
Figure 3:
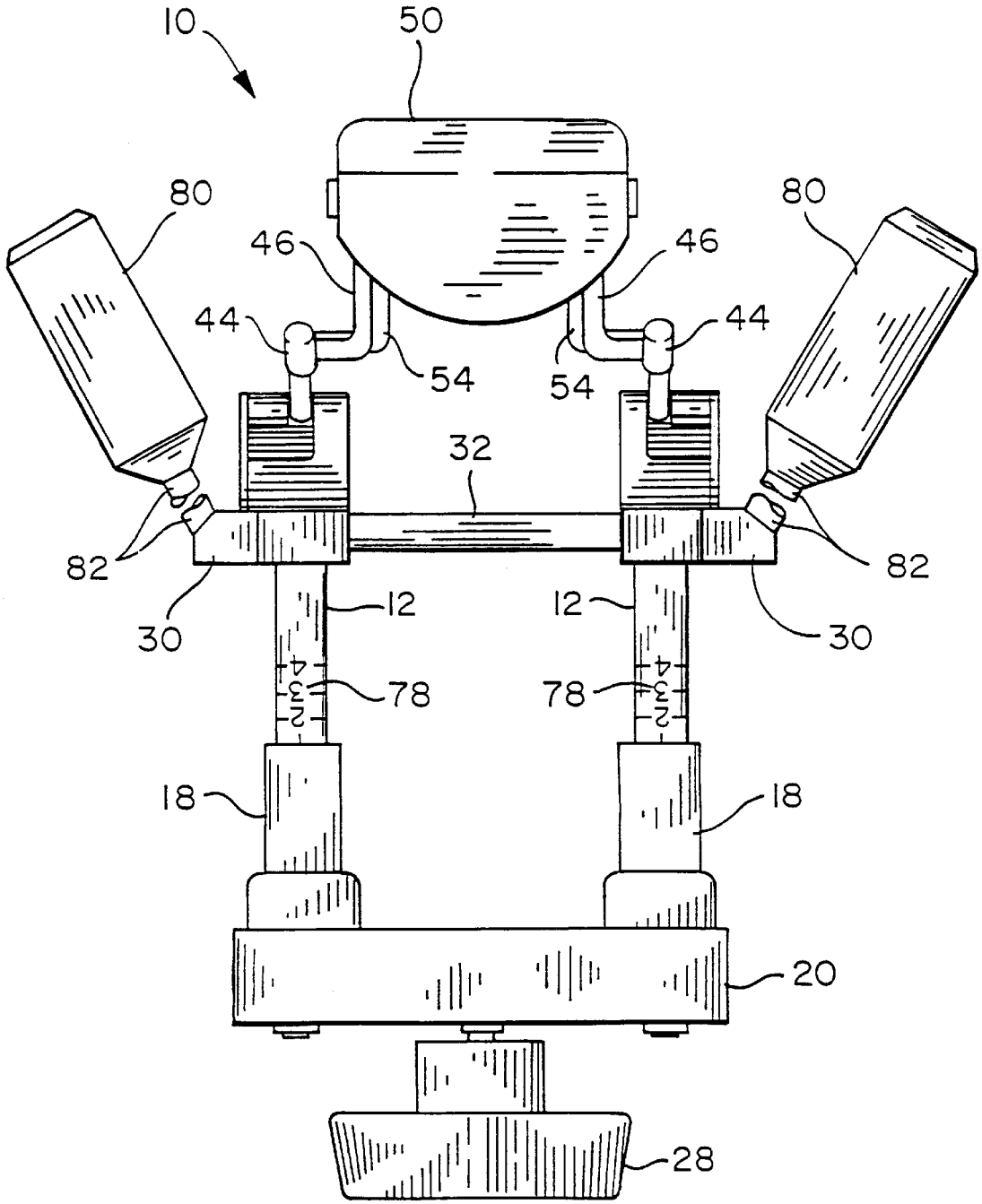
FIG. 3 is a top plan view.
Figure 4:
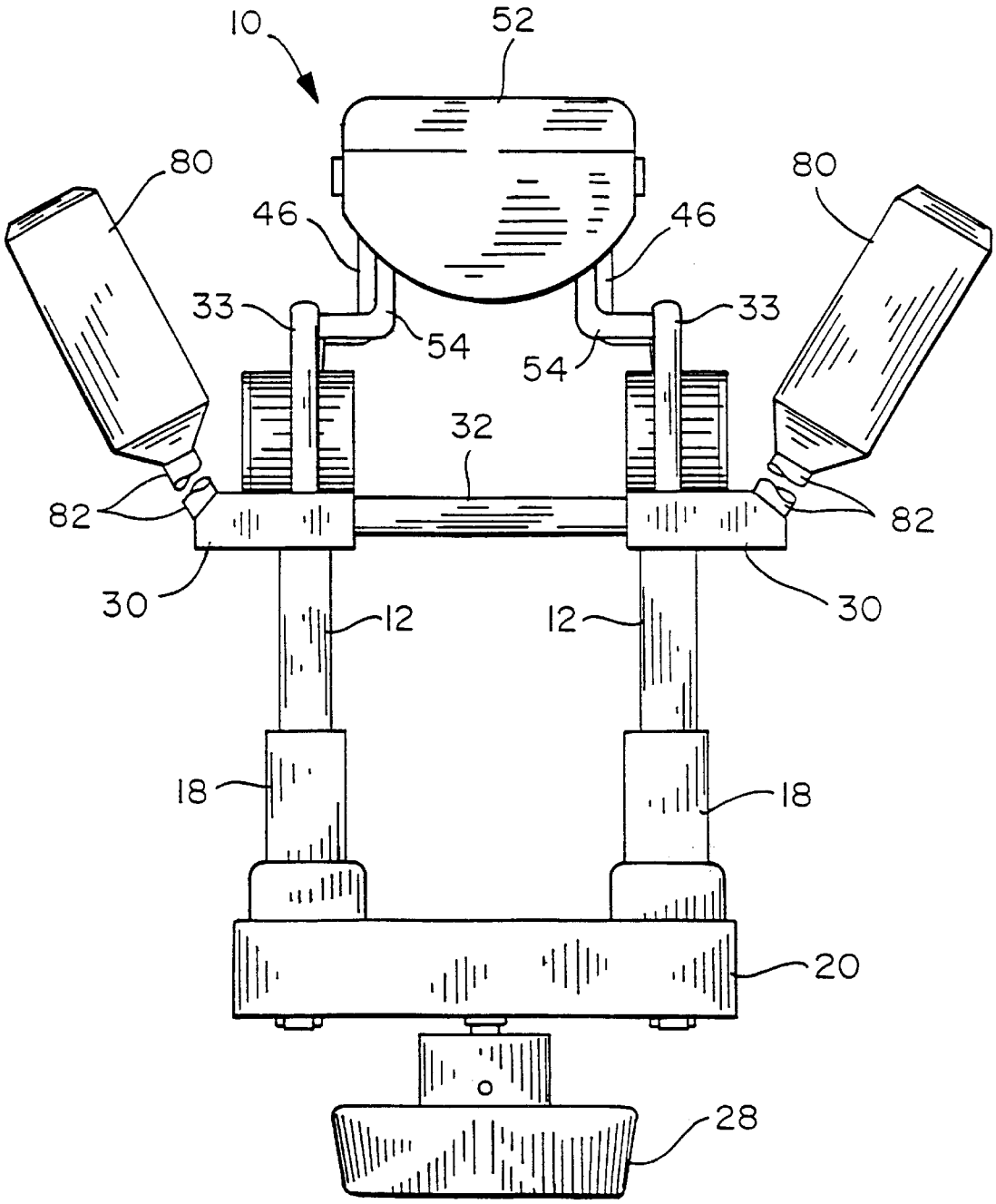
FIG. 4 is a bottom plan view.
Figure 5:
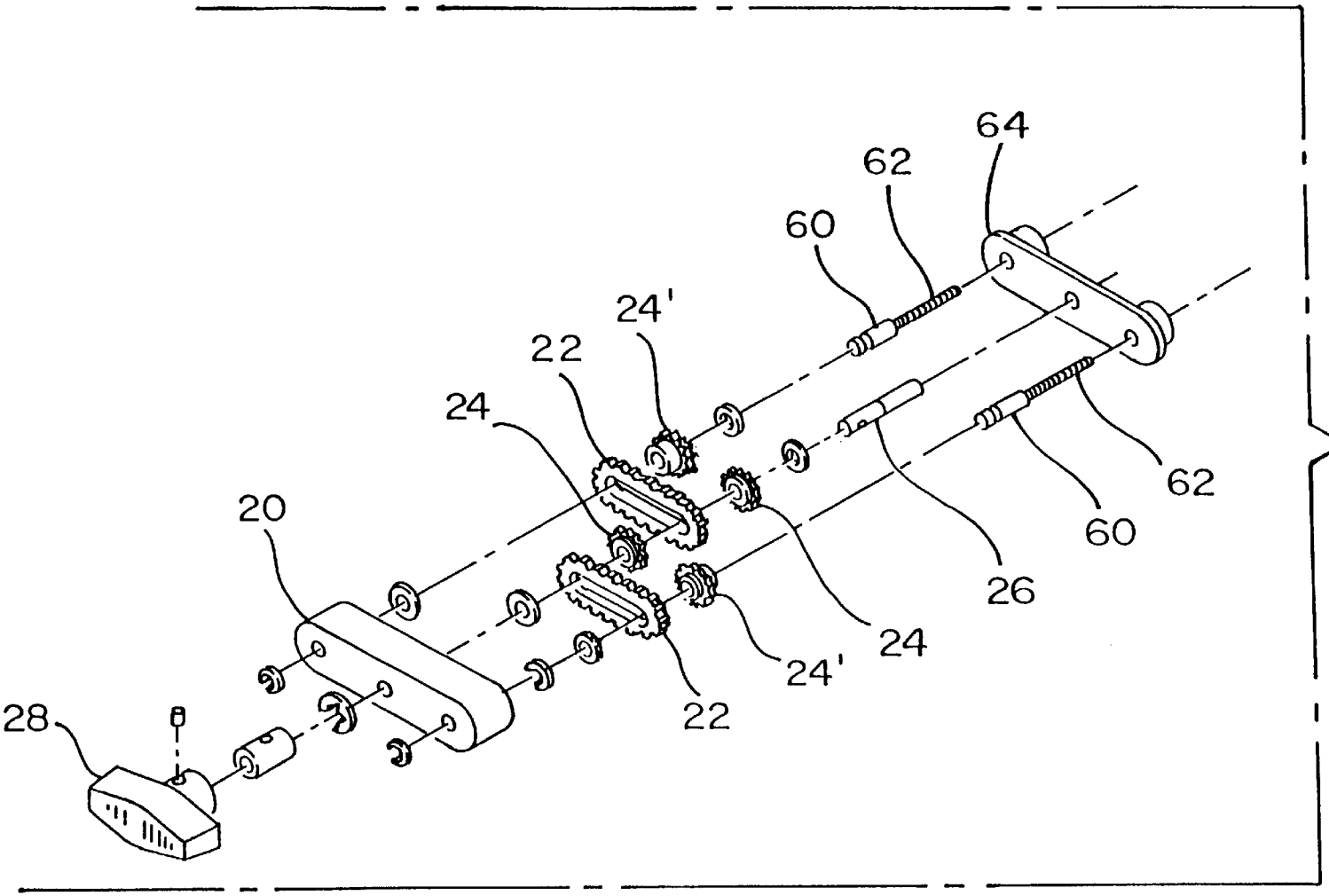
FIG. 5 is an exploded view of a portion of the device including the housing and knob.
Figure 6:
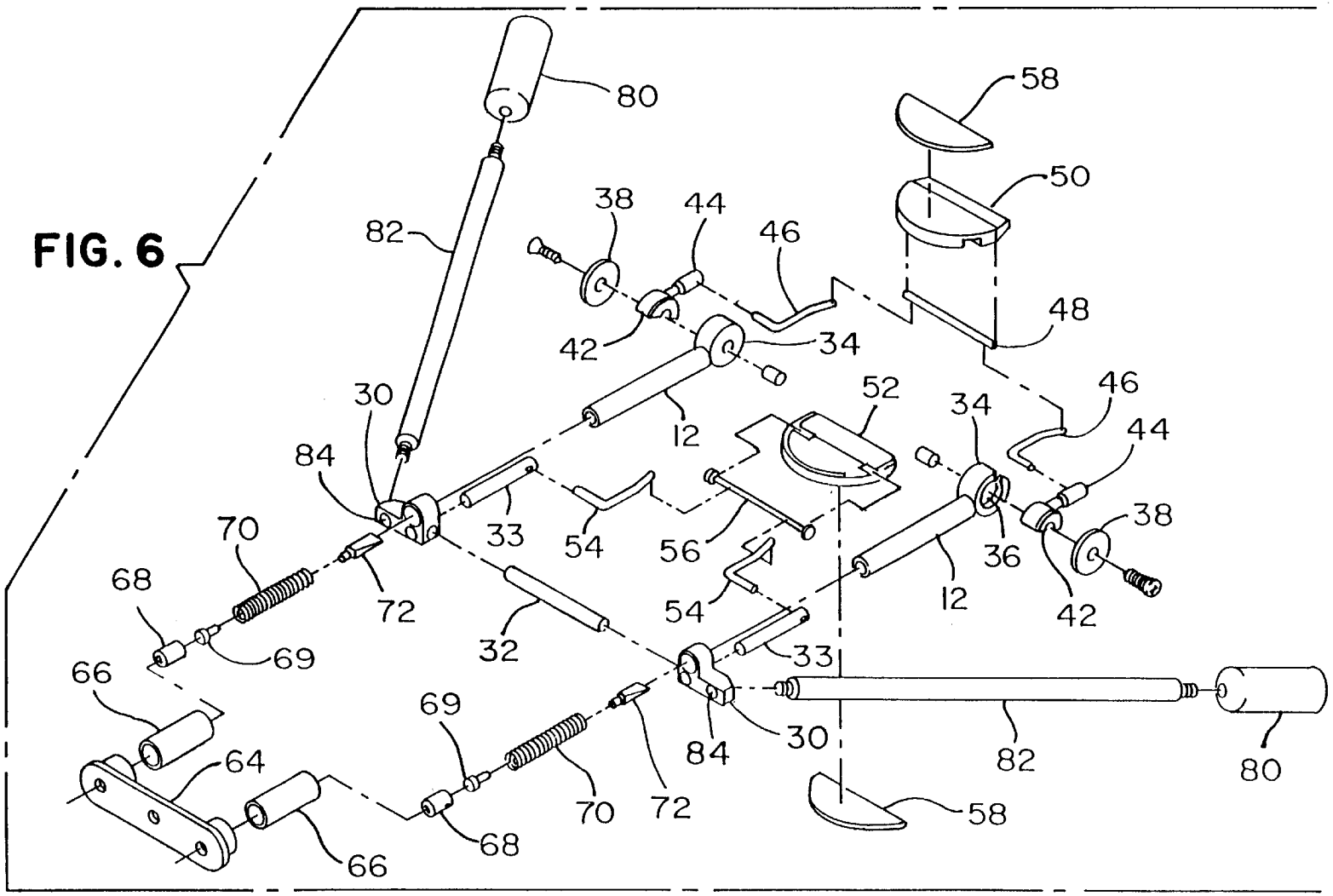
FIG. 6 is an exploded view of a second portion of the device showing all of the components exterior of the housing.
Figure 23:
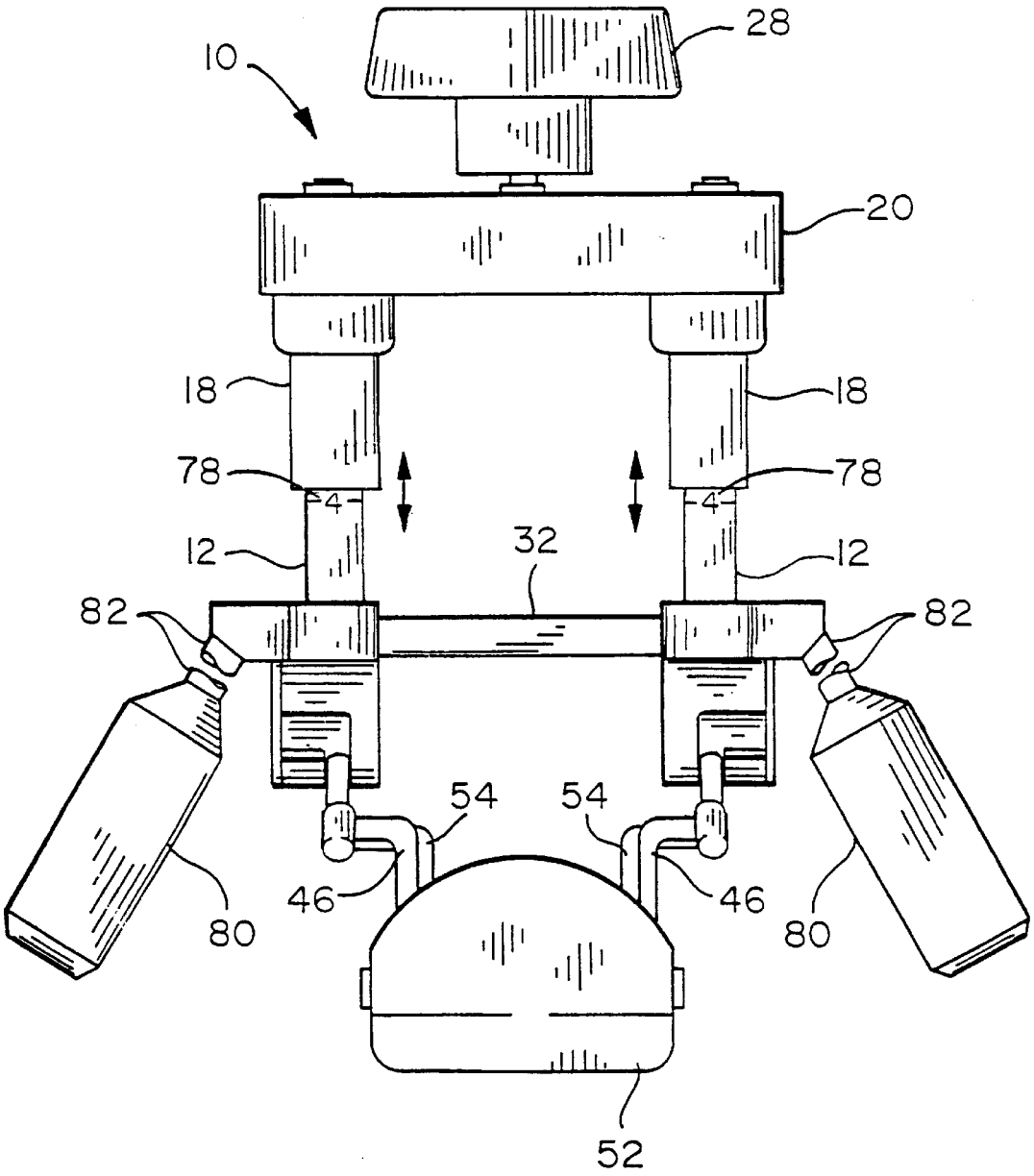
FIG. 23 is a top plan view showing the indicia when the distance between the mouthpieces is relatively small.

A plurality of spaced-apart indicia 78, such as numerals, are provided on the outer surface of at least one, and preferably on both, of the side members 12. The indicia 78 are located where the side member 12 is telescopically received in the sleeve 66 such that movement of the side members 12 can be easily gauged by observing which indicia are visible. As shown in FIG. 23, the indicia reading is approximately "3" and the distance between the mouthpiece is approximately 82% of the maximum. In FIG. 3 the indicia reading is approximately "1" and the distance between the mouthpiece is approximately 10% of the maximum. Through the use of the indicia, an adjustment means is provided to quantify the tension and force applied to the springs to adjust the effective lengths of the side members 12. The term "effective length" is used because, although the actual length of each side member is not changed, the telescoping of the side member 12 in the respective sleeves 18 produces an effective length of each side member. This effective length is dependent upon the rotation of the knob 28 and effectively varies the distance between the housing and the mouthpieces while simultaneously varying the distance between the upper mouthpiece 50 and the lower mouthpiece 52. Also, the indicia provide a means to reproduce the distance between the mouthpieces. The user of the device can vary the distance between the mouthpieces in small, controllable, increments.

Figure 24:
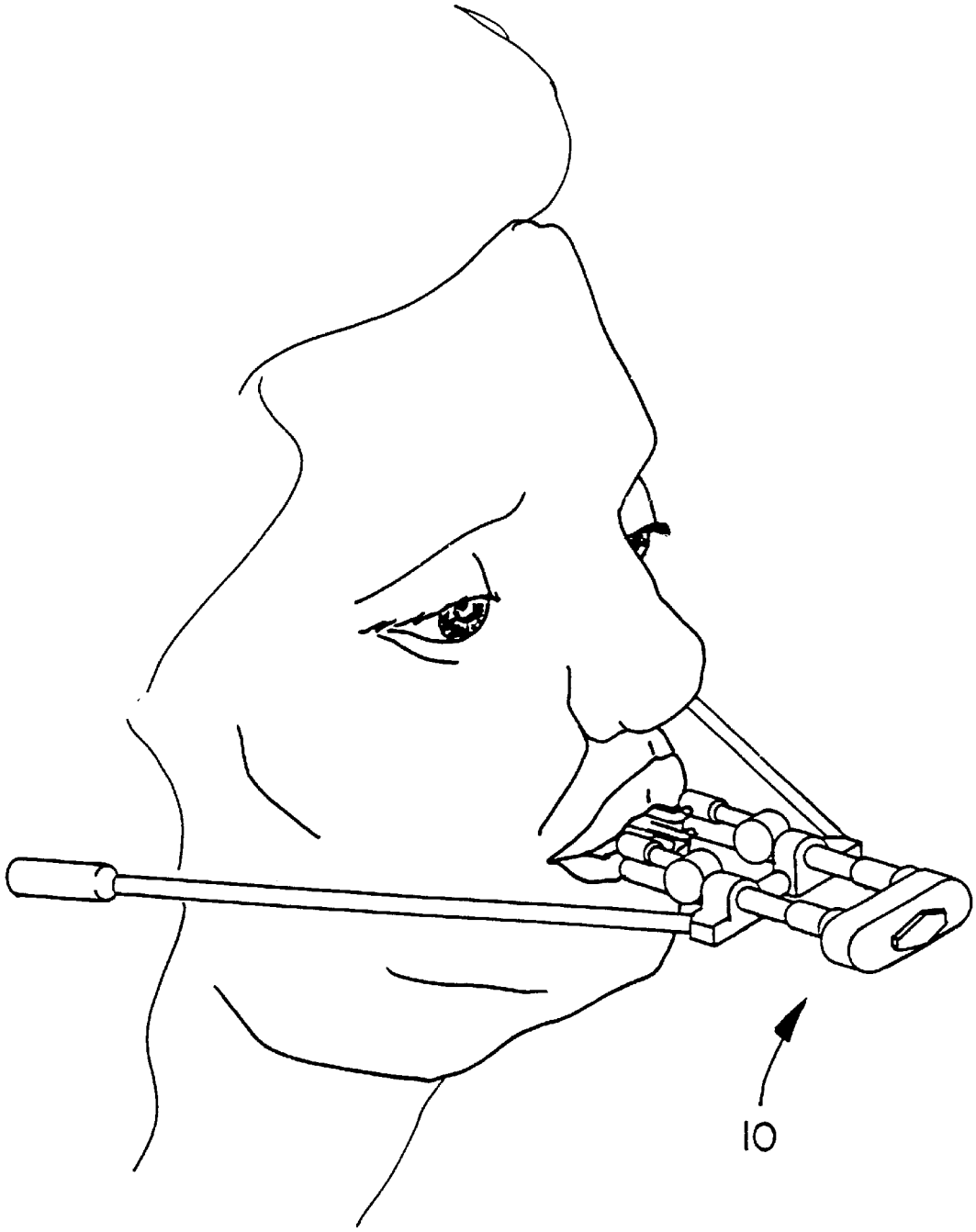
FIG. 24 is a perspective view of the device of the present invention in the mouth of a patient.

A pair of counter balance weights 80 are provided to be removably attached to the device 10. Preferably, each weight 80 is connected to a respective rod 82. The rods 82 are threaded at the end opposite from the weight 80 and each is received in a cooperatively threaded opening 84 formed in the frame, preferably in the cross brace knuckle 30 on opposite sides of the frame. The rods 82 are oriented toward the mouthpieces 50, 52 with the respective weights 80 on opposite sides of the patient's head and distal from the housing 20. The counterbalance weights 80 are particularly useful when the patient is in a standing or sitting position (FIG. 24). The weights 80 are of a mass to balance the weight and leverage of the frame and housing 20 which extends from the patient's mouth. The counterbalance weight 80 reduce stress on the teeth and jaws of the patient. When the patient is lying down, with device 10 extending upwardly from the patient's mouth, the counterbalance weights are not necessary.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A device to assist in the therapy of a patient who has limited jaw opening, the device comprising:

a frame having two opposite side members, the side members having adjustable lengths, means to adjust the lengths of the side members concurrently, each side member having a first end and an opposite second end, an upper mouthpiece and a lower mouthpiece connected between the respective first ends of the side members of the frame, the upper mouthpiece and the lower mouthpiece having a distance therebetween wherein manually adjusting the length of the side members of the frame exerts tension on a respective concentric planetary rotational surface, the respective concentric planetary rotational surfaces being connected to one of the mouthpieces, thereby changing the distance between the upper mouthpiece and the lower mouthpiece, said means to adjust the length of the side members concurrently, also adjusting the distance between the upper mouthpiece and the lower mouthpiece by a predetermined amount, wherein, when the mouthpieces are received in the mouth of the patient, the jaw opening of the patient is adjustable to a predetermined distance.

2. The device of claim 1, further comprising the frame having a housing and a cross brace rod opposite thereto, the housing and the cross brace rod being approximately perpendicular to the opposite two side members of the frame.

3. The device of claim 1, wherein two tensioning means are provided, one tensioning means being connected to each of the side members.

4. The device of claim 3, wherein each tensioning means is provided with a mechanism for quantifiably adjusting the amount of tension.

5. The device of claim 1, further comprising the frame having a housing and two sleeves, the sleeves being connected to the housing and being spaced-apart, the second ends of the respective side members being received in each of the sleeves such that the respective side member may telescope within the respective sleeve.

6. The device of claim 1, further comprising a pair of mouthpiece pads, one pad being attached to the upper mouthpiece and the other pad being attached to the lower mouthpiece, the pads being replaceable, the pad serving to cushion teeth and gums of the patient and to provide hygienic replacements.

7. A device to assist in the therapy of a patient who has limited jaw opening, the device comprising:

a frame having two opposite side members, the side members having adjustable lengths, means to adjust the lengths of the side members concurrently, each side member having a first end and an opposite second end, an upper mouthpiece and a lower mouthpiece connected between the respective first ends of the side members of the frame, the upper mouthpiece and the lower mouthpiece having a distance therebetween wherein adjusting the length of the side members of the frame changes the distance between the upper mouthpiece and the lower mouthpiece, the frame having a housing and a cross brace rod opposite thereto, the housing and the cross brace rod being approximately perpendicular to the opposite two side members of the frame, the means to adjust the lengths of the side members includes the housing having sprockets and a drive means therein, the sprockets being connected to the side members wherein movement of the drive means in a first direction concurrently lengthens the side members and movement of the drive means in a second opposite direction concurrently shortens the side members, and wherein when the mouthpieces are received in the mouth of the patient, the jaw opening of the patient is adjustable.

8. The device of claim 7, further comprising a knob mounted externally of the housing, the knob being connected to the drive means within the housing wherein the knob controls the drive means.

9. A device to assist in the therapy of a patient who has limited jaw opening, the device comprising:

a frame having two opposite side members, the side members having adjustable lengths, means to adjust the lengths of the side members concurrently, each side member having a first end and an opposite second end, an upper mouthpiece and a lower mouthpiece connected between the respective first ends of the side members of the frame, the upper mouthpiece and the lower mouthpiece having a distance therebetween wherein adjusting the length of the side members of the frame changes the distance between the upper mouthpiece and the lower mouthpiece, the frame having a housing and a cross brace rod opposite thereto, the housing and the cross brace rod being approximately perpendicular to the opposite two side members of the frame, wherein the cross brace rod is connected to a lower pivot rod, the lower mouthpiece being pivotally mounted on the lower pivot rod such that the lower mouthpiece pivots when received in the mouth of the patient, and wherein, when the mouthpieces are received in the mouth of the patient, the jaw opening of the patient is adjustable.

10. A device to assist in the therapy of a patient who has limited jaw opening, the device comprising:

a frame having two opposite side members, the side members having adjustable lengths, means to adjust the lengths of the side members concurrently, each side member having a first end and an opposite second end, an upper mouthpiece and a lower mouthpiece connected between the respective first ends of the side members of the frame, the upper mouthpiece and the lower mouthpiece having a distance therebetween wherein adjusting the length of the side members of the frame changes the distance between the upper mouthpiece and the lower mouthpiece, wherein each side member is connected to a respective head, each head having an opening formed therein, a respective joint being received in each opening, each joint being connected to the upper mouthpiece, each joint being resiliently connected to the respective side member such that adjusting the length of the side member moves the upper mouthpiece with respect to the lower mouthpiece, and wherein, when the mouthpieces are received in the mouth of the patient, the jaw opening of the patient is adjustable.

11. The device of claim 10, wherein each joint is connected to an upper pivot rod, the upper mouthpiece being pivotally mounted on the upper pivot rod such that the upper mouthpiece pivots when received in the mouth of the patient.

12. A device to assist in the therapy of a patient who has limited jaw opening, the device comprising:

a frame having two opposite side members, the side members having adjustable lengths, means to adjust the lengths of the side members concurrently, each side member having a first end and an opposite second end, an upper mouthpiece and a lower mouthpiece connected between the respective first ends of the side members of the frame, the upper mouthpiece and the lower mouthpiece having a distance therebetween wherein adjusting the length of the side members of the frame changes the distance between the upper mouthpiece and the lower mouthpiece, wherein two tensioning means are provided, one tensioning means being connected to each of the side members, wherein each side member has a center bore formed longitudinally therethrough, a spring being disposed in each bore, the spring having a first end and a second end, an adjusting means connected to the first end of the respective spring, a chisel tip connected to the second end of the spring, the first end of each side member being connected to a respective head, each head having an opening formed therein, a respective joint being received in each opening, a concentric planetary rotational surface being formed on each joint, the respective chisel tip bearing on the concentric planetary rotational surface, the spring and concentric planetary rotational surface being the tensioning means, wherein adjustment of the adjustment means produces a quantifiable force to extend or contract the spring and adjust the lengths of the side members, and wherein, when the mouthpieces are received in the mouth of a patient, the jaw opening of the patient is adjustable.

13. The device of claim 12, further comprising a plurality of spaced-apart marks being defined on at least one of the side arms such that adjustments of the length of the side arm may be quantified and reproduced.

14. A device to assist in the therapy of a patient who has limited jaw opening, the device comprising:

a frame having two opposite side members, the side members having adjustable lengths, means to adjust the lengths of the side members concurrently, each side member having a first end and an opposite second end, an upper mouthpiece and a lower mouthpiece connected between the respective first ends of the side members of the frame, the upper mouthpiece and the lower mouthpiece having a distance therebetween wherein adjusting the length of the side members of the frame changes the distance between the upper mouthpiece and the lower mouthpiece, wherein a counterbalance weight is removably connected to the frame proximal to the upper mouthpiece and the lower mouthpiece such that the device is balanced in the patient's mouth and stress on the patient's jaw is avoided during use, and wherein, when the mouthpieces are received in the mouth of the patient, the jaw opening of the patient is adjustable.

15. A device to assist in the therapy of a patient who has limited jaw opening, the device comprising:

a frame having two side members, the side members each having an adjustable length, each side member having a first end and an opposite second end, means to adjust the lengths of the side members concurrently, an upper mouthpiece and a lower mouthpiece connected between the respective first ends of the side members of the frame, the upper mouthpiece and the lower mouthpiece having a distance therebetween, each side member having a center bore formed longitudinally therethrough, a spring being disposed in each bore, the spring having a first end and a second end, an adjusting means connected to the first end of each spring, a chisel tip connected to the second end of each spring, two heads, the first end of each side member being connected to a respective one of the heads, each head having an opening therein, a respective joint being received in each opening in the respective heads, a concentric planetary rotational surface being formed in each joint, the respective chisel tip bearing on the concentric planetary rotational surface, two spaced-apart sleeves, the respective second end of each side member being telescopically received in the respective sleeves, wherein changing the adjusting means on the first end of each spring changes the tension of the respective springs with respect to the concentric planetary rotational surface and telescopically moves the respective side members with respect to the sleeves thereby changing the distance between the upper mouthpiece and the lower mouthpiece, such that the jaw opening of the patient is adjustable in controllable increments.

16. A device adapted to be received in a patient's mouth to assist in the therapy of the patient who has limited jaw opening, the device comprising:

a frame having attached thereto an upper mouthpiece and a lower mouthpiece, the upper mouthpiece and the lower mouthpiece having a variable distance therebetween, the respective mouthpieces being received in the mouth of the patient and contacting the teeth of the patient, the frame having a pair of arms, each arm having a variable length, each arm bearing on a respective concentric planetary rotational surface, the concentric planetary rotational surfaces each being connected to the upper mouthpiece such that varying the length of the arms varies the distance between the upper mouthpiece and the lower mouthpiece, a manual control means attached to the frame for adjusting the length of the frame, wherein the opening of the jaw of the patient may be adjusted by the control means during use.

17. In a device to assist in the therapy of a patient who has limited jaw opening, the improvement comprising:

a frame extending outwardly from the jaw of the patient wherein an upper mouthpiece and a lower mouthpiece are connected to the frame and are received in the mouth of the patient during use, a manually-operated knob centrally positioned on the frame, the knob being connected to two arms, each arm engaging a respective concentric planetary rotational surface, each concentric planetary rotational surface operating on respective sides of one of the mouthpieces, wherein movement of the knob moves the arms on the concentric planetary rotational surfaces in unison to move the one of the mouthpieces with respect to the other mouthpieces and such that movement of the knob is calibrated to produce a desired movement between the upper mouthpiece and the lower mouthpiece.

18. A therapy device intended to correct or alleviate a condition of trismus suffered by a patient, comprising a frame extending forwardly of the patient's mouth and including a pair of parallel telescoping side members joined by a crosspiece disposed distally of the patient's mouth, a knob carried by the crosspiece substantially centrally thereof and connected to the parallel telescoping side members, such that turning the knob in a clockwise or counterclockwise direction will alternately advance or retract the parallel telescoping side members, a pair of mouthpieces intended to be inserted into the patient's mouth and including at least one mouthpiece connected to the parallel telescoping side members such that turning the knob to alternately advance or retract the parallel telescoping side members will change the spacing between the mouthpieces in the patient's mouth, the spacing between the mouthpieces being gradually increased to increase the pressure on the patient's jaw, thereby ultimately correcting or alleviating the patient's trismus condition, and at least one of the mouthpieces being resiliently biased so that said one mouthpiece may be moved towards the other mouthpiece to diminish the distance between the mouthpieces and thereby diminish the pressure on the patient's jaw in the event the patient experiences any pain or discomfort during the respective physical session.

* * * * *